US011274522B2

(12) United States Patent
Wang et al.

(10) Patent No.: US 11,274,522 B2
(45) Date of Patent: Mar. 15, 2022

(54) SYSTEMS AND TECHNIQUES FOR CONTROLLING AND MONITORING DOWNHOLE OPERATIONS IN A WELL

(71) Applicant: Schlumberger Technology Corporation, Sugar Land, TX (US)

(72) Inventors: Chao Wang, Missouri City, TX (US); Julien Bost, Sugar Land, TX (US); Vincent Nicolas, Missouri City, TX (US); Abbigail Ullrich, Houston, TX (US); Quangen Du, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/707,746

(22) Filed: Dec. 9, 2019

(65) Prior Publication Data

US 2020/0115992 A1 Apr. 16, 2020

Related U.S. Application Data

(63) Continuation of application No. 15/242,063, filed on Aug. 19, 2016, now Pat. No. 10,502,024.

(51) Int. Cl.
*E21B 34/10* (2006.01)
*E21B 47/06* (2012.01)
(Continued)

(52) U.S. Cl.
CPC ..... *E21B 34/10* (2013.01); *E21B 33/124* (2013.01); *E21B 43/116* (2013.01); *E21B 47/06* (2013.01);
(Continued)

(58) Field of Classification Search
CPC ..... E21B 2200/06; E21B 2200/04; E21B 33/124; E21B 34/10; E21B 43/116; E21B 47/06; E21B 47/12; E21B 49/08
See application file for complete search history.

(56) References Cited

U.S. PATENT DOCUMENTS 6,371,208 B1 4/2002 Norman et al.
6,450,263 B1 * 9/2002 Schwendemann .... E21B 34/063 166/317
(Continued)

FOREIGN PATENT DOCUMENTS

WO 2015077183 A1 5/2015

OTHER PUBLICATIONS

Extended Search Report issued in the EP Application 17842037.8, dated Apr. 1, 2020 (3 pages).
(Continued)

*Primary Examiner* — Caroline N Butcher
(74) *Attorney, Agent, or Firm* — Cameron R. Sneddon

(57) ABSTRACT

An apparatus and method for using a pressure-powered tool to perform a downhole operation in a well determine the operating condition of the tool based on indications of pressure in a region associated with the tool. If the pressure indications are indicative of an undesired operating condition, corrective action is taken, such as mechanically shifting the tool or rupturing the rupture disc of an electric rupture disc (ERD) system to shift the tool to a desired operating condition.

20 Claims, 8 Drawing Sheets

(51) Int. Cl.

| | |
|---|---|
| ***E21B 47/12*** | (2012.01) |
| ***E21B 49/08*** | (2006.01) |
| ***E21B 33/124*** | (2006.01) |
| ***E21B 43/116*** | (2006.01) |

(52) U.S. Cl.
CPC ..... *E21B 47/12* (2013.01); *E21B 49/08* (2013.01); *E21B 2200/04* (2020.05); *E21B 2200/06* (2020.05)

(56) References Cited

U.S. PATENT DOCUMENTS

| | | | |
|---|---|---|---|
| 6,550,551 | B2 | 4/2003 | Brunnert et al. |
| 6,571,886 | B1 | 6/2003 | Sullivan et al. |
| 6,722,439 | B2 | 4/2004 | Garay et al. |
| 6,951,331 | B2 | 10/2005 | Haughom et al. |
| 6,966,380 | B2 | 11/2005 | McLoughlin et al. |
| 7,377,333 | B1 | 5/2008 | Sugiura |
| 7,624,807 | B2 | 12/2009 | Vick, Jr. |
| 8,434,515 | B2 | 5/2013 | Nilssen |
| 8,646,533 | B2 | 2/2014 | Nguy et al. |
| 8,836,325 | B2 | 9/2014 | Prost et al. |
| 9,359,859 | B2 | 6/2016 | Ross et al. |
| 9,382,769 | B2 | 7/2016 | Wilson et al. |
| 2005/0263279 | A1* | 12/2005 | Vachon ..... E21B 23/006 166/250.01 |
| 2007/0215349 | A1 | 9/2007 | Reid et al. |
| 2008/0115574 | A1 | 5/2008 | Meek |
| 2008/0217021 | A1 | 9/2008 | Lembcke et al. |
| 2012/0267119 | A1 | 10/2012 | Patel |
| 2012/0285702 | A1 | 11/2012 | Rytlewski |
| 2014/0286129 | A1 | 9/2014 | Longfield et al. |
| 2014/0318787 | A1 | 10/2014 | Tirado et al. |
| 2014/0338894 | A1* | 11/2014 | Mace ..... F42D 1/02 166/243 |
| 2015/0267533 | A1* | 9/2015 | Millot ..... E21B 47/16 340/854.4 |
| 2015/0354351 | A1 | 12/2015 | Morrow et al. |
| 2018/0051535 | A1 | 2/2018 | Wang et al. |

OTHER PUBLICATIONS

International Search Report and Written Opinion issued in the related PCT Application PCT/US2017/047070, dated Nov. 20, 2017 (18 pages).

International Preliminary Report on Patentabilitiy issued in the related PCT Application PCT/US2017/047070, dated Feb. 28, 2019 (15 pages).

* cited by examiner

SYSTEMS AND TECHNIQUES FOR CONTROLLING AND MONITORING DOWNHOLE OPERATIONS IN A WELL

CROSS-REFERENCE TO RELATED APPLICATIONS

The present application is a Continuation of co-pending U.S. patent application Ser. No. 15/242,063 filed 19 Aug. 2016, now U.S. Pat. No. 10,502,024, which is herein incorporated by reference.

BACKGROUND

Hydrocarbon fluids, including oil and natural gas, can be obtained from a subterranean geologic formation, referred to as a reservoir, by drilling a wellbore that penetrates the formation. Once a wellbore is drilled, the formation is tested to determine productive capacity, pressure, permeability and nature of the reservoir fluids, the extent of the reservoir in the formation, or a combination of these characteristics. This testing, which is referred as drill stem testing (DST) generally involves lowering a test string made up of a variety of components into the wellbore, hydraulically isolating a layer of interest from the rest of the well and perforating the layer using perforating guns to enable fluid to flow from the layer either into a chamber that is part of the test string or to the surface through suitable tubing. The components in the test string can include a test valve, packer, perforation guns and various sensors.

Often a formation has multiple layers of interest from which a production fluid can flow. Because the various layers traversed by the wellbore can have different characteristics, testing of such arrangements may involve isolating each layer from the others so that the characteristics of that layer can be assessed independently of the other layers. In many arrangements, testing starts at the lowest layer of the formation and sequentially moves up after each test is performed. However, sequential testing may require the test string to be removed from the wellbore so that the tested layer can then be hydraulically isolated from the higher layers. Repeatedly pulling a test string and then running it back into the well is time consuming and adds significantly to the total time needed to completely test the well. Once tested, various completion components can be installed to enable and control the production of fluids from the various layers.

Before, during and after completion of the well, including during testing of the well to determine a completion strategy, data representative of various downhole parameters, such as reservoir pressure and temperature, as well as data representative of the state of various downhole components (e.g., flow valves, test valves) are monitored and communicated to the surface. In addition, control information is communicated from the surface to various downhole components, to enable, control or modify downhole operations, such as control signals to actuate various downhole tools and to shift one or more tools from one state to another. Wired, or wireline, communication systems can be used for the communications between the surface and downhole. Wireless communication systems, such as those that use acoustic or electromagnetic transmission mediums, also can be used to exchange information between downhole components and surface systems.

SUMMARY

In general, embodiments provide a method for testing a subterranean formation intersected by a well that includes running a test string into the well, where the test string includes a pressure-powered tool that can be shifted between multiple states. The tool includes a fluid chamber containing pressurized fluid, a piston energizable by the pressurized fluid to shift the tool between states, and a hydraulic control system to energize the tool. According to the method, a pressure indication in a region associated with the piston is provided and the state of the tool is identified based on that pressure indication.

Embodiments also include a system to perform a test in a hydrocarbon well. The system includes a control station and a pressure-powered tool. A pressure sensor provides indications of pressure in a region within the tool, and the control station determines the operating condition of the tool based on the pressure indications.

In accordance with some embodiments, the operating condition of a pressure-powered tool can be determined by observing pressure in the tool during shifting of the tool between operating states. The observed pressure is compared to an expected pressure to determine the tool's operating condition. Corrective action is taken if the tool is in an undesired operating condition.

BRIEF DESCRIPTION OF THE DRAWINGS

Certain embodiments are described with reference to the accompanying drawings, wherein like reference numerals denote like elements. It should be understood, however, that the accompanying drawings illustrate the various implementations described herein and are not meant to limit the scope of various technologies described herein. The drawings show and describe various embodiments.

DETAILED DESCRIPTION

In the following description, numerous details are set forth to provide an understanding of the present embodiments. However, it will be understood by those skilled in the art that the present embodiments may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention.

Embodiments of various features of the systems and techniques disclosed herein will be described in the context of a multizone testing system for a hydrocarbon well. It should be understood, however, that the embodiments are not limited to downhole testing, and that many of the features of the systems and techniques can be employed after testing has been performed, including during and after completion of the well.

Figure 1:
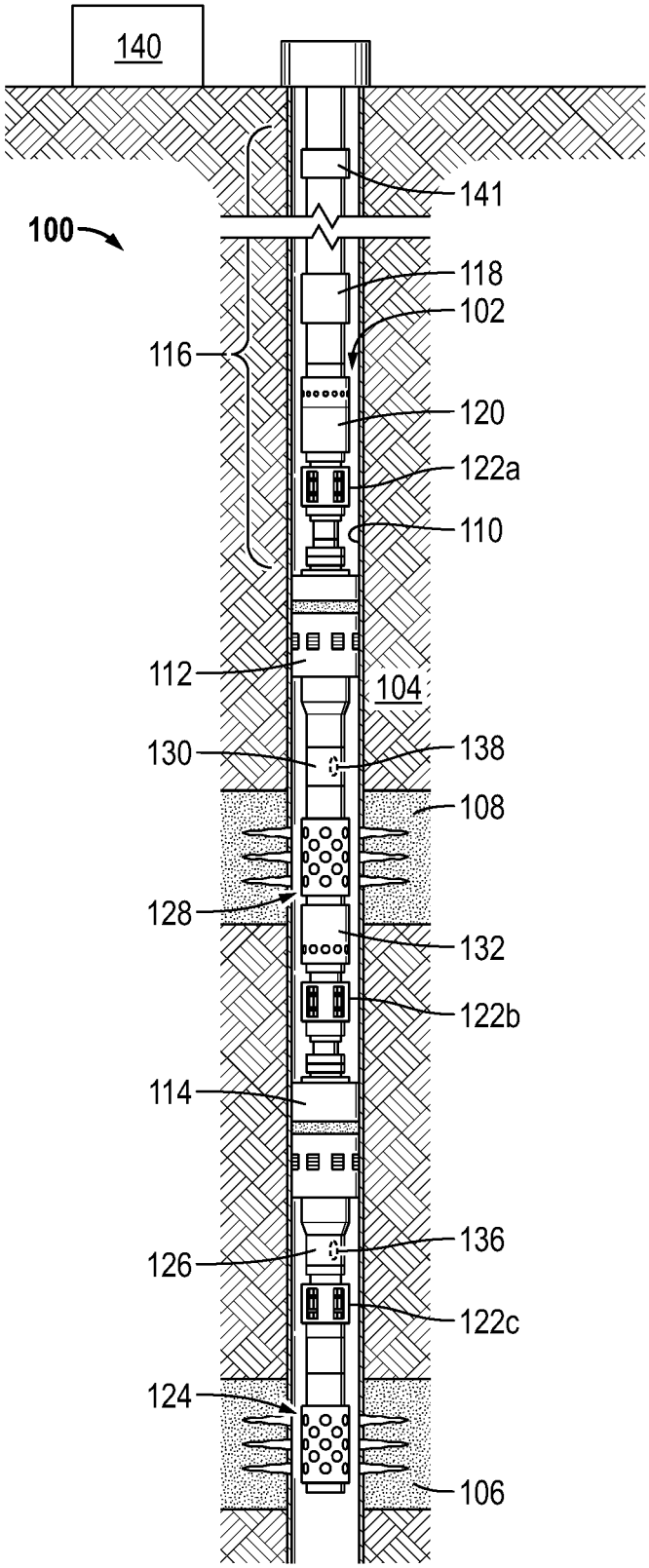
FIG. 1 illustrates a multi-zone test system including pressure-powered tools, according to an embodiment.

Referring now to the figures, and more particularly to FIG. 1, a downhole, single trip, multi-zone testing system 100 according to one embodiment is shown. System 100 is designed for use in a hydrocarbon well 102 that penetrates a formation 104 having multiple zones or layers 106 and 108. Although only two layers 106 and 108 are shown, it should be understood that system 100 can be configured for use with more than two layers. System 100 is equipped with an inner tubing or casing 110 through which hydrocarbon fluids from the layers 106, 108 can flow. However, it should be understood that embodiments of the systems and techniques disclosed herein also be used in uncased wells, gravel packed wells, deviated wells, etc.

In the example of FIG. 1, the downhole testing system 100 includes an upper isolation packer 112 and a lower isolation packer 114 to isolate the two zones 106 and 108 from each other and from an upper subsystem 116. The upper subsystem 116 includes a control station 118 for exchanging information with apparatus below the upper packer 112. The upper subsystem 116 further includes a main valve 120 that serves to permit or to prevent the flow of hydrocarbon fluid from the lower zones to the upper subsystem 116. This main valve 120 can be, for example, a dual-valve, made of a ball valve and a sleeve valve, such as the Intelligent Remote Dual Valve tool available from Schlumberger. The upper subsystem 116 further includes remotely controllable test equipment 122*a*, such as a fluid analyzer, flow meter, pressure gauges and a sampler carrier as examples. Remotely controllable test equipment 122*b* and 122*c* also are provided in the region below the upper packer 112.

In addition to test equipment 122*a,b*, the string located below the upper packer 112, includes an array of apparatuses connected in series, each apparatus being adapted for the testing of one layer and comprising a series of tubing and remotely activated tools for hydraulically isolating and testing the corresponding layer. As shown, the string includes a first perforating gun system 124 and flow sub 126 adjacent the first zone 106, and a second perforating gun system 128 and flow sub 130 adjacent the second zone 108, each of which can be remotely controlled. The apparatuses adjacent the first zone 106 and second zone 108 are hydraulically isolated by a remotely actuated intermediate valve 132 in order to prevent the flow of hydrocarbon fluid from the lower zone 106 to the upper zone 108. In the example shown, the intermediate valve 132 is a sleeve valve having flow ports that open to an inner annulus between the upper perforating guns 128 and the casing 110. It should be understood, however, that in some embodiments, the well can be pre-perforated so that test string can be run into the well without perforating guns 124 and/or 128. In such embodiments, the flow subs 126 and 130 can be replaced with flow valves for testing. It should further be understood that the intermediate valve 132 and any test valves can be any type of suitable valve, including ball valves as another example.

Under operation, the downhole multizone testing system 100 is run and positioned into the well 102 such that each perforating gun system 124, 128 is adjacent a layer to be tested. Once the upper and lower packers 112, 114 are set, the lower zone 106 can be perforated using the perforating gun system 124. To flow the lower zone, the main valve 120 and the intermediate valve 132 are opened. The fluid from the lower zone 106 flows into the inner tubing through a flow port 136 of the flow sub 126 and then out of the flow ports of the intermediate valve 132 into the inner annulus between the casing 110 and the upper portion of the inner tubing, and then into the flow port 138 of the flow sub 130 and into the upper portion of the inner tubing. If buildup of pressure is required to test the lower zone 106, then the intermediate valve 132 can be closed for buildup and then re-opened to continue testing the lower zone. In this manner, the lower zone can be tested individually and independently of the upper zone by, for example, using test equipment 122*b* and/or 122*c* to take measurements of pressure and flow and samples of the fluid to determine its composition.

Once testing of the lower zone 106 is complete, then the intermediate valve 132 can be closed and preparations made to test the upper zone 108. If not pre-perforated, then the upper zone is perforated using perforating gun system 128 and the main valve 120 is controlled to flow and test the upper zone 108 in a manner similar to that performed for the lower zone 106.

After testing of the individual zones is complete, the intermediate valve 132 can be re-opened. With both the intermediate valve 132 and the main valve 120 open, the flow from both zones is commingled. Testing of the commingled flow can provide useful information regarding well performance (e.g., commingled flow versus individual flow) that can be used to develop a completion strategy for the development of the hydrocarbon field.

In the example embodiment shown in FIG. 1, the control station 118 is arranged to communicate with a surface control and acquisition system 140 and with the downhole apparatuses. The control station 118 thus provides for a communication path between the surface and the downhole systems so that the equipment can be controlled and telemetry can be collected. The communication path between the surface and the control station 118 and between the control station 118 and the downhole apparatuses can be wired and/or wireless. For any wireless portion, communications can be exchanged using either electromagnetic signals or acoustic signals, depending on the particular arrangement in which the system 100 is deployed. As an example, in FIG. 1, communications path between the control station 118 and the surface system 140 is an electromagnetic path that can include one or more repeaters 141. The communication path between the station 118 and the downhole apparatuses is an acoustic link that uses the test string as the transmission medium.

Figure 2:
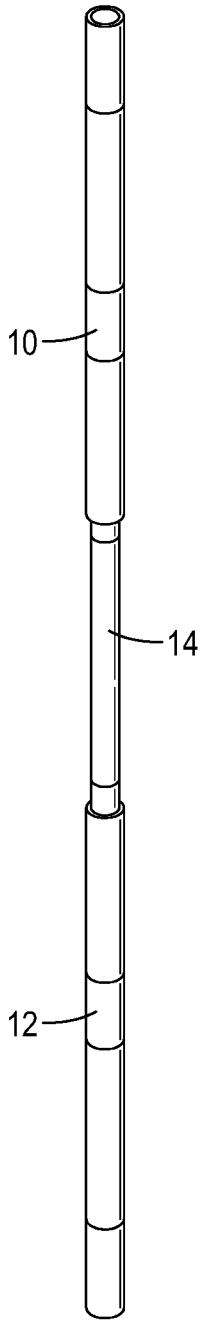
FIG. 2 illustrates examples of flow valves that can be used in the system of FIG. 1, according to an embodiment.

During testing, or during other operations performed in the well, it can be useful to control the rate at which fluid flows from a layer into the inner tubing (test tubing, production tubing, etc.). In embodiments described herein, fluid flow is achieved by providing multiple flow valves, each of which has different sized flow ports. FIG. 2 illustrates two differently sized flow valves 10 and 12 that are controlled by a common control system 14 that can communicate simultaneously with both valves 10 and 12. In the example illustrated, valve 10 has a flow area of 1 $in^2$ and the valve 12 has a flow area of 2 $in^2$. By controlling the valves 10 and 12 simultaneously, four different flow areas can be achieved. In this example, both valves 10 and 12 can be closed so that there is no flow; valve 10 can be open and valve 12 closed so that the total flow area is 1 $in^2$; valve 10 can be closed and valve 12 open so that the total flow are is 2 $in^2$; and both valves 10 and 12 can be open so that the total flow area is 3 $in^2$.

Granular control of the flow rate in this manner during testing can provide information that is useful to establish a production plan for the well. The technique also can be used in a production environment. Further, although a single control system 14 is shown for valves 10 and 12, individual control systems also can be used and the valves need not be actuated simultaneously. Yet further, it should be understood that while two valves are shown, embodiments can employ more than two valves and the valves can have a variety of different flow areas.

Before, during and after the testing, it also is useful to know the state of the downhole tools, such as the position (open, closed) of the various downhole valves. It also is useful to know the operating condition of the downhole tools (e.g., whether the tool is operating as expected, whether a failure condition is occurring, etc.). Using a tool that includes a valve as an example, the state of a downhole valve generally can be measured or monitored using a variety of techniques, including those that rely on contact with a feature of the valve, such as by using a potentiometer or a limit switch, and those that do not require physical contact with any portion of the valve, such as by using a Hall effect sensor or a Reed switch. However, the sensing components used for both contact-type and non-contact-type arrangements generally require either sufficient space and/or structure in which to position and support the sensor and some type of communication architecture to enable communication of information between the sensing components and the surface systems. And, even when such direct sensing components are used, they generally cannot provide information that can be used to indicate the operating condition of equipment or that could be used to predict whether, where and/or when a failure might occur. Further, in many downhole applications, there often are substantial constraints on the amount of physical space that is available for the various components that are run downhole. Also, communication systems having large amounts of bandwidth to exchange the volumes of control and monitoring information conveyed in both testing and production environments (including valve position information) can be challenging.

Embodiments described herein therefore provide an indirect technique to identify the state of a pressure-powered tool, such as a hydraulically activated downhole tool, such as a valve. In some embodiments, the technique further can be used to identify an unexpected or abnormal operating condition and to predict whether and when failure of the tool may occur. Rather than employing a sensor to provide a direct measurement or indication of the tool's position, the technique infers information about the pressure-powered tool from sensors or gauges that are monitoring the pressure in various hydraulic control lines and fluid chambers as they fill and empty of an activating fluid (e.g., oil). Indications of pressure obtained from any of these pressure sensors (or other sensors) from the zone or region in which the tool is deployed can be used to determine the state and/or the operating condition of the tool.

Figure 3:
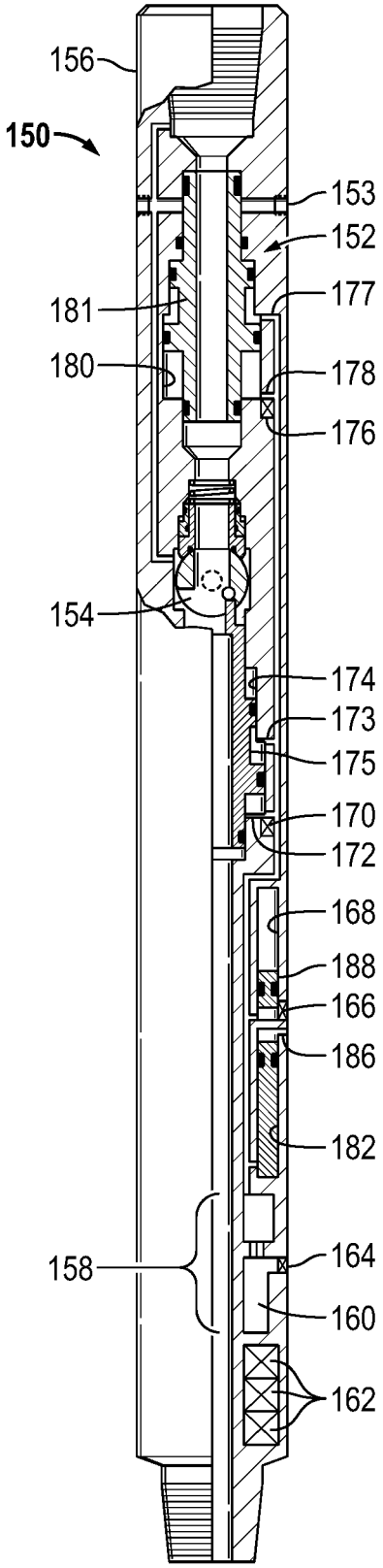
FIG. 3 illustrates an example of a pressure-powered tool that can be used in the system of FIG. 1, according to an embodiment.

For example, FIG. 3 schematically illustrates an example of a tool 150 that can be used for the main valve 120 in the system of FIG. 1. The tool 150 includes a sleeve valve 152 and a ball valve 154 within a tubing 156 that forms a cylindrical housing. The sleeve valve 152 opens and closes flow ports 153 that provide a fluid communication path through the wall of the tubing 156. In FIG. 3, the sleeve valve 152 is shown in the closed position. The ball valve 154 opens and closes a fluid communication path within the tubing 156 itself. In FIG. 3, the ball valve 154 is shown in the open position.

Both valves 152 and 154 are activated by a hydraulic control system 158 that is housed within the tubing 156. The hydraulic control system 158 responds to command signals received from a remote control system, such as the control station 118 in FIG. 1. In response to a command signal, the hydraulic control system 158 can cause either or both of the valves 152 and 154 to be hydraulically opened or closed. In the embodiment shown, the hydraulic control system 158 includes electronics 160 that are powered by a battery 162 and that respond to command signals that are transmitted from the control station 118. In various embodiments, the communication path between the remote control station 118 and the hydraulic control system 158 is a wireless communication path. As an example, the remote control station 118 can communicate with the surface via an electromagnetic link and with the hydraulic control system 158 via an acoustic link.

The tool 150 in FIG. 3 also includes a pressure gauge 164 that is arranged to measure the hydrostatic pressure of the well, a pressure gauge 166 to measure the pressure of a dump chamber 168, a pressure gauge 170 to measure the pressure of a hydraulic control line 172 that feeds into a piston chamber 174 of the valve 154, and a pressure gauge 176 to measure the pressure of a hydraulic control line 178 that feeds into a piston chamber 180 of the valve 152.

To energize/de-energize the valves 152, 154, the hydraulic control system 158 establishes fluid communication between a hydrostatic chamber 182 and the piston chambers 174, 180. The hydrostatic chamber 182 contains a fluid (e.g., clean oil) that is held in the chamber by a movable seal 184 and that can be conveyed to the piston chambers 174, 180 of the valves 152, 154 through hydraulic control lines 172, 178 in order to energize pistons 175, 181, causing them to slide and change the position of the valves. The chamber 182 also has a port 186 that is open to the well such that the pressure in the hydrostatic chamber 182 is approximately the same as the hydrostatic pressure in the well. The dump chamber 168 initially is empty of fluid and is sealed at atmospheric pressure by a movable seal 188. The dump chamber 168 is fluidly coupled to the control lines 173, 177 such that fluid from the piston chambers 174, 180 can empty into the atmospheric chamber 168 as the pistons 175, 181 are de-energized to change the position of the valves 152, 154.

As an example, the hydraulic control system 158 can control movement of the valves 152, 154 by establishing or interrupting the fluid communication paths between the hydrostatic and dump chambers 182, 168 and the piston chambers 174, 180, such as by generating electrical signals to activate various solenoid valves that are associated with the hydraulic control lines 172, 173, 177, 178.

In embodiments described herein, measurements of pressure in one or more of the hydrostatic, dump and piston chambers and the various hydraulic control lines are monitored and analyzed in order to determine the state and/or operating condition of the valves (or other hydraulically activated tool). To that end, FIGS. 4 and 5 schematically illustrate an embodiment of an example of an in-tool hydraulic control and monitoring arrangement 200 that can be used in a pressure-powered tool.

Figure 4:
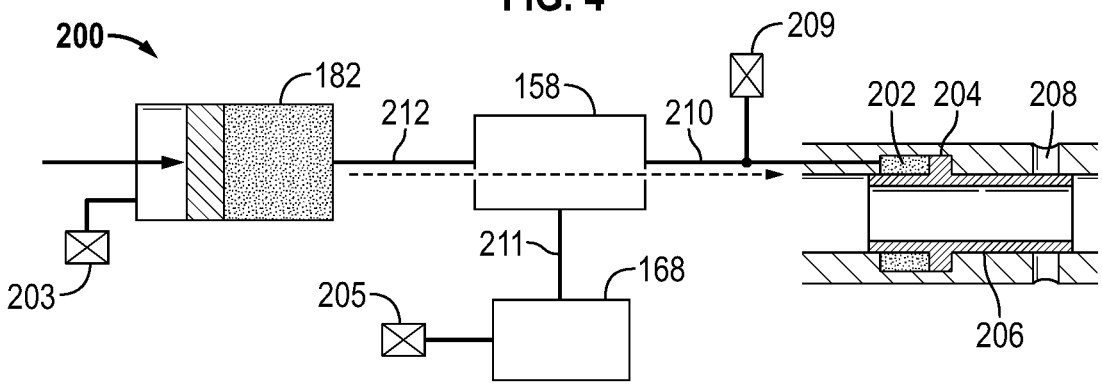
FIG. 4 schematically illustrates an example in-tool leak detection arrangement used in a pressure-powered tool in a first operating condition, according to an embodiment.
Figure 5:
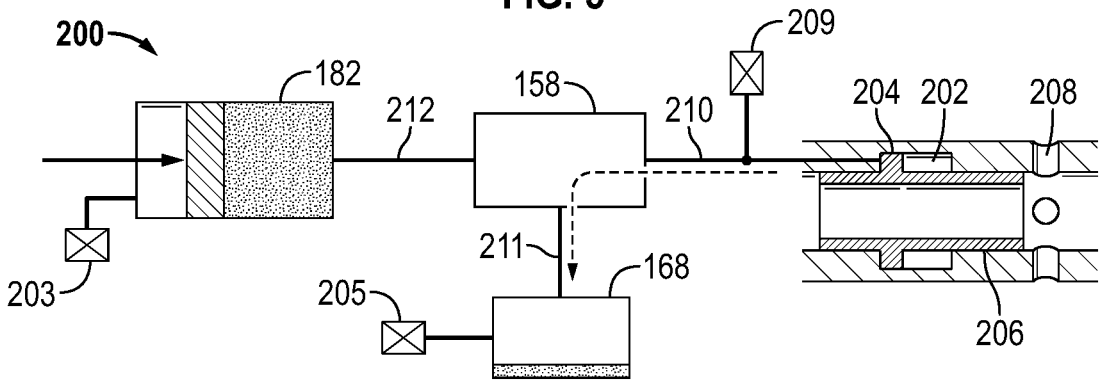
FIG. 5 schematically illustrates an example in-tool leak detection arrangement used in a pressure-powered tool in a second operating condition, according to an embodiment.

In FIG. 4, the arrangement 200 includes the hydraulic control system 158 which provides a fluid communication path between the hydrostatic chamber 182 and a piston chamber 202 of a pressure-powered piston 204 via hydraulic control lines 210, 212. The system 158 also provides a fluid communication path between the piston chamber 202 and the dump chamber 168 via hydraulic control line 210, 211. Again, the hydraulic control system 158 can include various valves, such as solenoid valves, to establish and interrupt fluid communication via the control lines 212, 211. As shown in FIG. 4, the hydrostatic chamber 182 contains a reservoir of clean oil to drive the piston 204 (here, used for a valve). The chamber 182 is open to the well such that the pressure in the chamber 182 is approximately the same as the hydrostatic pressure of the well. A pressure gauge 203 can provide measurements of the hydrostatic pressure.

In general, the size of the hydrostatic chamber 182 is sufficient to provide enough oil to cycle the tool a predetermined number of times. For example, in a downhole test environment, the tool may be cycled between six to twelve times and the chamber 182 will contain a sufficient volume of oil to complete the desired number of cycles.

Initially, the pressure in the dump chamber 168 is close to atmospheric pressure. As the piston 204 is cycled, the dump chamber 168 will fill with oil that is emptied from the piston chamber 202 and the pressure in the dump chamber 168 will gradually increase. In FIG. 4, the arrangement 200 includes a pressure gauge 205 to provide indications of the pressure in the dump chamber 168.

The arrangement 200 also includes a pressure gauge 209 that is positioned so that it can provide an indication of the pressure in the portion of the hydraulic control line 210 that feeds into the piston chamber 202. In some embodiments, the pressure gauge 209 (or a separate pressure gauge) can be positioned so that it can provide an indication of the pressure in the piston chamber 202 itself.

In general, the pressure in the well, the control lines and the various chambers will follow predictable patterns under normal operating conditions where the tool is energized/de-energized. As an example, the in-tool arrangement 200 illustrated in FIG. 4 includes a sleeve valve where, in the closed position, a flow mandrel 206 seals off flow ports 208 that otherwise are open to the well. The movement of flow mandrel 206 is accomplished by filling the piston chamber 202 with clean oil from the hydrostatic chamber 182. When the valve is closed, the pressure in the piston control line 210 (or in the piston chamber 202) that is measured by the pressure gauge 209 should be approximately the same as the hydrostatic pressure in the well, which is approximately the same pressure in the hydrostatic chamber 182 (measured by the gauge 203).

In FIG. 5, to open the valve, the fluid path to the dump chamber 168 is opened such that the oil in the piston chamber 202 empties into the dump chamber 168 and the flow mandrel 206 retracts from its position where it was sealing the flow ports 208. Thus, in the open condition, the pressure in the piston control line 210 (or in the piston chamber 202) that is measured by pressure gauge 209 should be close to the pressure in the dump chamber 168 that is measured by the pressure gauge 205.

Although arrangement 200 in FIGS. 4 and 5 has been described for use in conjunction with a sleeve valve, and in the energized state of the piston 204, the sleeve valve is in a closed position. In the de-energized state, the sleeve valve is in an open position. Other embodiments of arrangement 200 can be used with other types of pressure-powered tools that are shifted to different operating positions when the piston is energized and de-energized. As an example, in an embodiment where arrangement 200 is used with a ball valve, in the energized state, the ball valve is closed (i.e., blocking the fluid flow path). When the piston of the ball valve is de-energized, the ball valve shifts to an open state (i.e., the fluid flow path is open).

Figure 6:
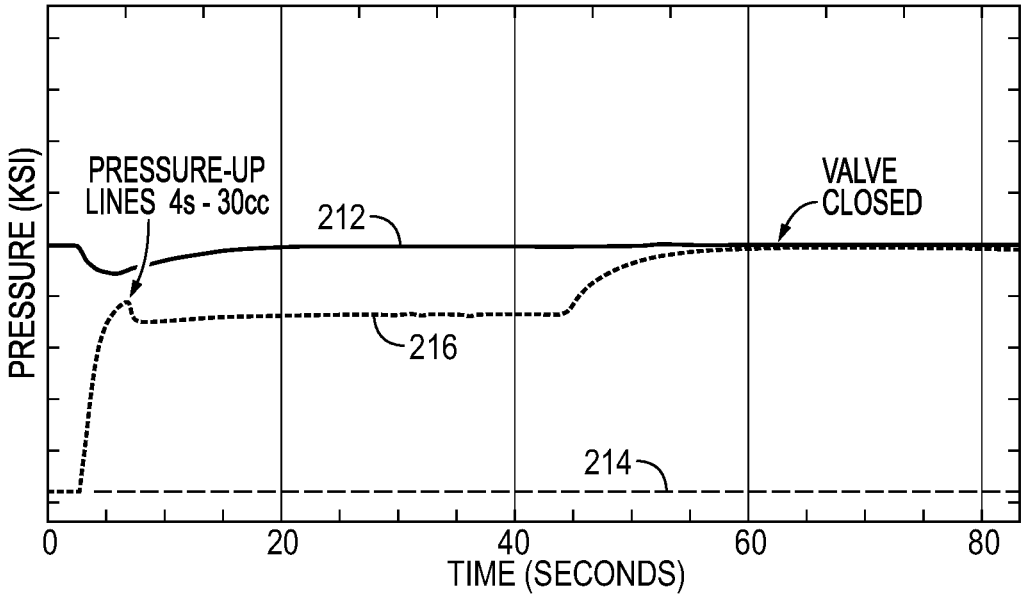
FIG. 6 is an example graph of pressure observed in various regions associated with a pressure-powered tool, according to an embodiment.

The pressure in the piston control line 210 (and in the piston chamber 202) also will have a predictable behavior during the period of time in which energization/de-energization of the piston 204 is taking place. An example of this behavior is shown in FIG. 6, which is a graph of pressure versus time. The measurements of pressure represented by the vertical axis are relative measurements so that no units are shown. The time scale on the horizontal axis is in seconds, with each major division representing approximately 5 seconds. The line 212 on the graph represents the pressure of the hydrostatic chamber 182 that is measured by the pressure gauge 203. The line 214 represents the pressure in the dump chamber 168 that is measured by the pressure gauge 205. The line 216 represents the pressure in the piston control line 210 that is measured by the pressure gauge 209.

At t=0 in FIG. 6, the piston 204 is a de-energized state with the piston chamber 202 empty such that the pressure in the control line 210 is approximately the same as the pressure in the dump chamber 168. At t=4 seconds, the hydraulic control system 158 establishes a fluid path between the hydrostatic chamber 182 and the piston chamber 202 so that the piston control line 210 is pressured up. As such, the pressure in the piston control line 210 spikes, accompanied by a slight dip in the pressure in the hydrostatic chamber 182 which then quickly returns to a steady state value. As the tool slowly shifts position, the pressure in the control line 210 remains fairly constant at a level that is slightly below the hydrostatic pressure. When the piston 204 nears its fully energized position, the pressure in the control line 210 begins to increase towards hydrostatic pressure. When the piston 204 is fully energized, the pressure in the piston control line 210 and the pressure in the hydrostatic chamber 182 are approximately the same. When the piston 204 is de-energized, a similar predictable pattern in pressure measurements, in reverse, should be observed.

Accordingly, observation of the pressure in the piston control line 210 and/or the hydrostatic and dump chambers 182, 168 can provide information from which the state of the tool 200 can be inferred with a high degree of reliability. Thus, for example, if the expected condition of the tool is energized (e.g., sleeve valve is closed, ball valve is open, etc.), and the pressure measured in the piston control line 210 deviates from the hydrostatic pressure, then an operator of the system can determine that the tool is not in the expected state even without a direct measurement of the tool state or position itself. Likewise, if the expected state of the tool is de-energized (e.g., sleeve valve is open, ball valve is closed, etc.) and the pressure in the control line 210 deviates from the pressure in the dump chamber 168, then an operator of the system again can determine that the tool 200 is not in the expected state or position. Similarly, if the measurements of pressure during the energization/de-energization of the tool 200 deviate from the expected pattern, then the deviation can be used as an indication that the state or the operating condition of the tool 200 is not as expected.

To further illustrate how the pressure measurements can be used, and with reference again to FIGS. 4 and 5, in the scenario presented by FIG. 4, the hydraulic control system 158 has established a fluid communication path between the hydrostatic chamber 182 and the piston chamber 202 in order to energize the piston 204 and cause the flow mandrel 206 to move to close the flow ports 208. The pressure gauge 209 is monitoring the pressure in the piston control line 210 and the pressure gauge 203 is monitoring the pressure in the hydrostatic chamber 182 (or the hydrostatic pressure in the well). When the piston 204 is energized, the piston chamber 202 is full of clean oil and the pressure in the piston control line 210 should be approximately the same as the pressure in the hydrostatic chamber 182. However, if there is a leak in the hydraulic control system 158 (e.g., a solenoid valve in a fluid communication path is not properly sealing), then the oil in the piston control line 210 may leak into the dump chamber 168 (which is at a lower pressure). If this occurs, then the pressure in the piston control line 210 will slowly decrease, accompanied by a slow increase in pressure of the dump chamber 168.

Another example of a problem condition will described with reference to FIG. 5. In this example, the piston 204 is de-energized, i.e., the hydraulic control system 158 establishes a fluid communication path between the piston chamber 202 and the lower-pressure dump chamber 168 so that the fluid in the piston chamber 202 empties into the dump chamber 168. The flow mandrel 206 thus retracts so that it no longer is sealing the flow ports 208. In this condition, the pressure in the piston control line 210 and in the dump chamber 168 should be approximately the same. However, if there is a leak in the fluid paths in the hydraulic control system 158, the clean oil in the hydrostatic reservoir 182 may leak into the piston chamber 202. This leak will cause the pressure in the piston control line 210 to slowly increase along with the pressure in the atmospheric chamber 168.

Indications of pressure provided by the pressure gauges 203, 205, 209 can be conveyed to the control station 118 for processing to identify unexpected states of the tool 204 (indicating that a failure in the hydraulic control system or the tool has occurred) or behavior that is indicative of an unexpected operating condition. As part of that processing, one or more of the pressure indications from one or more of the pressure gauges 203, 205, 209 can be compared to predetermined thresholds and/or to predetermined patterns and/or analyzed for trends. The pressure indications provided by multiple of the gauges can also be compared to one another in order to confirm that the hydraulic control system 158 and piston 204 are operating as expected or determine that a failure has occurred or will occur. In some embodiments, if the failure condition is a leak, the processing can also estimate the rate of the leak and the amount of time remaining before the fluid in the hydrostatic chamber 182 is depleted so that the piston 204 no longer can be energized. If the processing determines that a failure has occurred or will occur, then the control station 118 can generate a message that is transmitted to the surface to apprise an operator of the condition. The operator can then take appropriate actions, such as a corrective action (e.g., activate a backup system to shift the tool to the desired state) or implement or modify a test or operating plan to take into consideration the amount of time remaining before the hydraulic control system and/or the tool fails.

Figure 7:
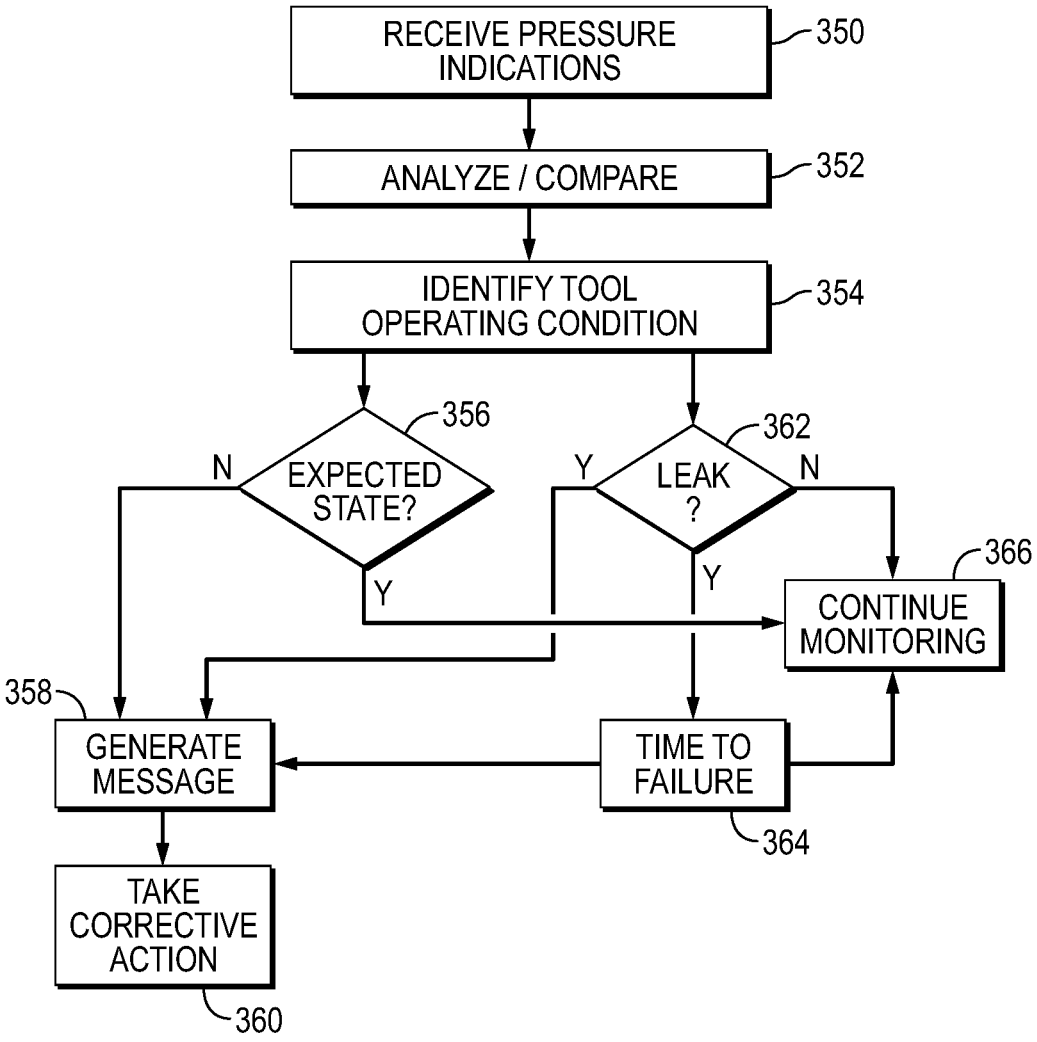
FIG. 7 is a flow diagram of an example technique to identify an operating condition of a pressure-powered tool, according to an embodiment.

FIG. 7 is a flow diagram of an example of a technique that can be implemented by the remote control station 118 to determine the state or operating condition of various pressure-powered downhole tools. At block 350, indications of pressure from pressure sensors (e.g., gauges 203, 205, 209) are received. At block 352, the pressure indications are analyzed to determine the operating condition of a tool, such as the state or position of the tool, the presence of fluid leaks in the tool, etc. Analysis can include comparing one or more of the pressure indications to predetermined thresholds or to each other. The analysis further can include observing the indications of pressure over a time window that corresponds to an event, such as a command to energize or de-energize a tool, and determining whether the observed changes in pressure over the time window are consistent with a predetermined pattern or a predetermined trend. The analysis further can include comparing the pressure measurements taken during a first event with the pressure measurements taken during the second event to identify trends. Other types of analytics can be applied to the pressure measurements that are suitable to determine the state and/or operating condition of the tool.

At block 354, the condition of the tool is determined (e.g., the valve is open or closed, a fluid leak is present, etc.). If the state (e.g., open, closed) is not the expected state (block 356), then a message can be sent to the surface to alert an operator (block 358) who can then take corrective action (block 360). The analysis of the pressure measurements also can identify a fluid leak that is the source of the unexpected state or that is indicative of an imminent failure of the tool (block 362). For instance, the pressure measurements may indicate that the piston has been energized but that there is a leak in the hydraulic control system such that a failure condition is imminent. At, block 364, based on pre-stored knowledge of the size of the hydrostatic reservoir, the number of times the tool has been cycled and the rate at which one or more of pressure indications are changing, the analysis also can estimate the time remaining or the number of cycles remaining before the pressure-powered tool fails. Again, the results of the analysis can be conveyed in a message to the surface (block 358) so that an operator can then take corrective action (block 360). Otherwise, pressure monitoring is continued (block 366).

Instructions for implementing the technique of FIG. 7 can be stored in a memory of the remote control station 118. Predetermined thresholds, predetermined behavior patterns, and indications of pressure received by the remote control station 118 also can be stored as data in a portion of the memory. The remote control station 118 further can include a processing device (e.g., a microprocessor, microcontroller, etc.) to process the stored instructions and access the stored data.

It should be understood that the algorithm represented in the flow diagram of FIG. 7 is exemplary only and that other algorithms can be implemented to identify the state and/or operating condition of a pressure-powered tool based on observations of pressure from the region in which the tool is deployed. The blocks shown in FIG. 7 also can be ordered in a different manner and may include more or fewer steps. Some blocks can be processed in parallel. It also should be understood that the processing of the data to identify the state or operating condition of the tool can be performed by processing systems that are deployed at locations other than the remote control station 118. For example, all or portions of the flow diagram shown in FIG. 7 can be performed by a processing system deployed in other apparatus in the string or by a surface system that is either local or remote from the well. It further should be understood that arrangements and techniques described above for determining the state or operating condition of a valve based on pressure measurements can be applied to any system that employs pressure-powered tools.

In some embodiments, if the operator has received a message indicating that the tool is in an unexpected state (e.g., open instead of closed; closed instead of open), then the operator can take a corrective action in the form of activating a backup system. One type of backup system for pressure-powered tools is a mechanical shifting system where a shifting tool is lowered into the string, such as by using slickline, wireline or coil tubing. The shifting tool is generally configured so that it has a mechanical feature that is shaped to engage or catch a shifting profile (e.g., also referred to as a fishing neck profile) on the tool's piston. Once engaged with the shifting profile, the shifting tool can be manipulated to either push or pull the piston so that the tool is shifted to the desired closed or opened state. However, a common type of failure mechanism for a pressure-powered tool is the occurrence of a hydraulic lock in the piston chamber that prevents the piston from moving. In general, mechanical shifting using a wireline, slickline or coil tubing tool cannot provide enough force on the piston to overcome a hydraulic lock.

Figure 8:
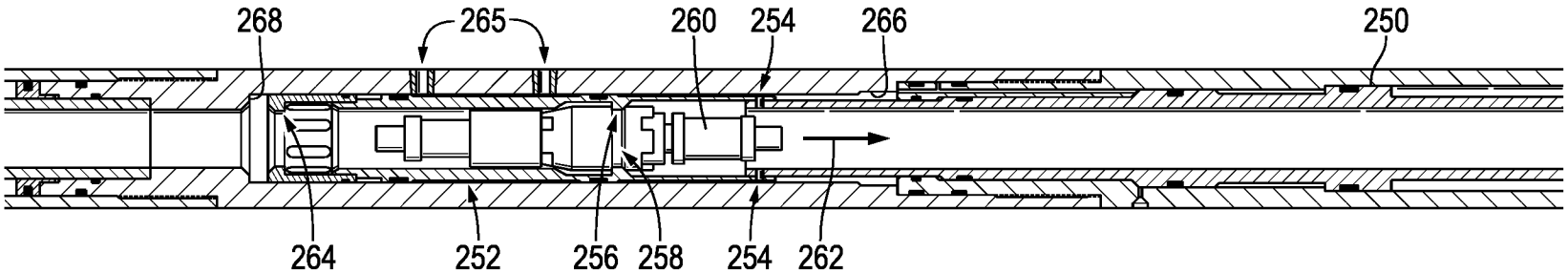
FIG. 8 illustrates a mechanical backup shifting system that can be used with a pressure-powered tool, according to an embodiment.

Accordingly, with reference to FIG. 8, mechanical backup shifting of a pressure-powered tool can be performed by configuring the tool so that its pressure-powered piston 250 is coupled to a flow sleeve or mandrel 252 by breakable fasteners 254. In the embodiment shown in FIG. 8, the flow mandrel 252 is coupled to the body of the piston 250 by shear fasteners 254, such as shear screws, that are designed to break when subjected to a laterally directed force. The interior wall of the mandrel 250 is provided with shifting features (e.g., abutments, protrusions, ramps, notches, etc.), each having a profile that can engage with or catch a complementary profile of a shifting feature provided on the outer surface of a shifting tool.

In the example of FIG. 8, the inner wall of the mandrel 252 includes a first profiled feature 256 that engages with a complementary profiled feature 258 on a shifting tool 260 and, once engaged, the shifting tool 260 can be used to push the flow mandrel 252 in the direction indicated by the arrow 262. The inner surface of the mandrel 252 also include a second profiled feature 264 that can engage with a complementary feature of the shifting tool (not shown). Once engaged with feature 264, the shifting tool can be used to pull the flow mandrel in the direction opposite to that indicated by the arrow 262.

In the example shown in FIG. 8, the piston 250 has been energized so that the valve is in a closed state, where the flow mandrel 252 seals the flow ports 265. However, a hydraulic lock condition in the piston chamber is present, preventing movement of the piston 250 to open the valve. Thus, using a slickline, wireline or coil tubing, the shifting tool 260 can be run into the cylindrical body of the flow mandrel 252 where it catches and engages with profiled feature 256. Once engaged, the shifting tool 260 is pushed in the direction of the arrow 262, thus exerting a lateral force on the fasteners 254, causing them to shear and release the flow mandrel 252 from the body of the piston 250. The flow mandrel 252 then moves separately from the piston 252 within the passageway 266 so that the valve is mechanically shifted to an open position where fluid can flow through at least one of the flow ports 265.

In the event that the valve is stuck in the open position, then the shifting tool 260 can again be run into the tubing to the flow mandrel 252 so that it catches the second profiled feature 264. Once engaged, the shifting tool 260 can be pulled in the opposite direction of arrow 262 so that the breakable fasteners 254 are sheared and the flow mandrel 252 is separated from the piston 250 body. The mandrel 252 can then be pulled until it reaches abutment 268. At this location, the mandrel 252 seals the flow ports 265 such that the valve has been mechanically shifted to a closed position.

A failure of a pressure-powered tool also can be the result of a failure in the electronics of the hydraulic control system. For instance, using a hydraulically activated valve again as an example, the piston may be movable, but the control electronics or the power source for the electronics may have failed. In the embodiments described thus far, failures or unexpected operating conditions were detected by monitoring the pressure in various control lines and chambers of the tool. These failure modes generally were caused by problems in the fluid communication paths, such as leaks in the control lines or hydraulic locks in the piston chamber, and not by failures of the electronics. If the electronic control system fails, it may be possible to activate a mechanical backup system, such as by using a shifting tool as described above, to shift the tool to a desired position. However, in the event that the downhole tool cannot be reached or the mechanical backup system cannot apply sufficient force to shift the downhole tool to a desired position, then a situation may be created where the operation or test being performed in the well may need to be shut down so that the string can be pulled, repaired and then re-deployed in the well. Such a procedure generally results in considerable costly downtime.

Accordingly, embodiments described herein further include an electro-hydraulic watchdog system that can monitor the health of the electronic portion of the hydraulic control system for a pressure-powered tool. If the watchdog system detects a failure in the electronics so that the hydraulic control system no longer is responsive to commands for controlling a pressure-powered tool, then the watchdog system can take over, actuate the tool and place it in a desired state, such as a failsafe state. For example, a desired state may be a state at which the tool can continue to operate so that testing or other operations can be completed.

Figure 9:
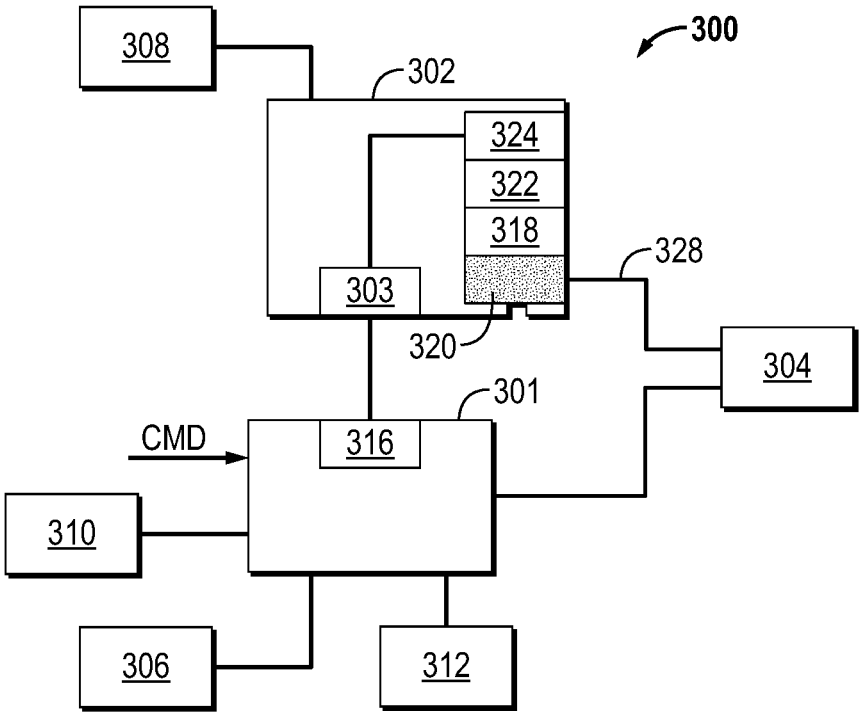
FIG. 9 schematically illustrates an example electric rupture disc (ERD) watchdog system that can be used with a pressure-powered tool, according to an embodiment.

With reference now to FIG. 9, a block diagram that schematically represents a tool 300 that includes a hydraulic control system 301 with a watchdog system 302 for a pressure-powered component 304 (e.g., a valve) is shown. In this example, the hydraulic control system 301 and the watchdog system 302 are powered by separate power sources 306, 308 (e.g., batteries) and are separately housed. As discussed with reference to FIGS. 4 and 5, the hydraulic control system 301 responds to commands received from a remote control station via either a wired or a wireless communication link. In response to the commands to energize/de-energize the component 304, the hydraulic control system 301 establishes or interrupts fluid communication paths between hydrostatic and dump chambers 310, 312 and the piston of the component 304.

In the example of FIG. 9, the hydraulic control system 301 also includes a heartbeat circuit 316 that generates a signal having a particular pattern or signature (e.g., a periodic signal) and/or a particular magnitude. The watchdog system 302 is communicatively coupled to the hydraulic control system 301 so that it can monitor the heartbeat signal via a heartbeat monitor circuit 303. The absence of a heartbeat signal or an incorrect heartbeat (e.g., wrong level, wrong pattern) is an indication that the hydraulic control system 301 no longer can respond properly to commands that it would have otherwise acted on to drive the tool to a desired state. In such an event, the watchdog system 302 takes over and generates a signal that will cause the pressure-powered valve 304 to shift to (or remain in) a desired position, such as a failsafe position in which the tool 300 can continue to operate.

In an embodiment, in addition to the circuitry 303 to receive and evaluate the heartbeat signal, the watchdog system 302 includes an electric rupture disc (ERD) 318, a reservoir 320 of clean oil that is subjected to the hydrostatic pressure of the well, a piston or projectile 322 and an energetic material 324. The reservoir 320 of the watchdog system 302 is fluidly coupled to the valve 304 through a hydraulic control line 328. When the watchdog system 302 detects the absence of a heartbeat signal or an incorrect heartbeat signal, a signal is generated that lights the energetic material 324 to propel the piston 322 so that it pierces the pressure membrane of the rupture disc 318. Piercing of the membrane operates to establish a fluid communication path between the watchdog oil reservoir 320 and the valve 304 through the line 328. The oil from the watchdog reservoir 320, which is at hydrostatic pressure, energizes the valve 304, thus forcing its piston to slide so that the valve 304 is placed in a desired position (e.g., flow ports of a valve are closed or opened).

In some embodiments, this same type of ERD watchdog system 302 can be used to initially actuate a pressure-powered tool that has a rupture port after it is set in place in the well, either for testing, completion or other well operations. Once initially actuated, the tool then can be hydraulically controlled by the system 301 shown in FIG. 9. Use of the ERD system to initially actuate the tool ensures that the tool is not prematurely activated before it is set and that the fluid used to energize its piston is clean fluid as opposed to fluids that may be present in the well.

Figure 10:
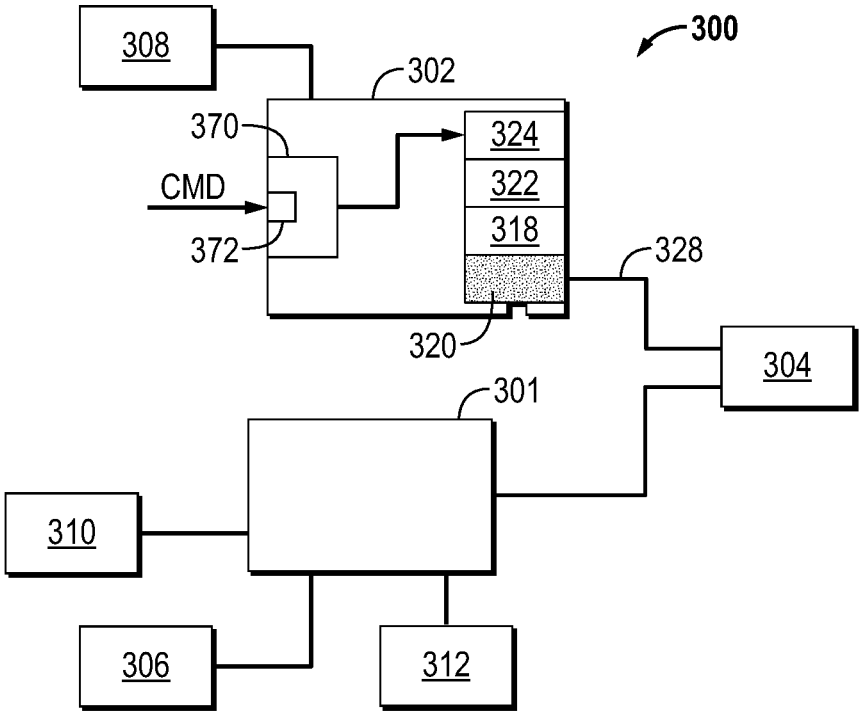
FIG. 10 schematically illustrates an example of another ERD system that can be used with a pressure-powered tool, according to an embodiment.

In some embodiments, as shown in FIG. 10, the ERD watchdog system 302 can be acoustically activated rather than activated by heartbeat monitoring. That is, rather than include the heartbeat monitor 303, the ERD housing can include an acoustic modem 370 with a transducer 372 (e.g., a piezoelectric transducer) that can respond to acoustic commands that are transmitted using the tubing as a communication path. In response to an acoustic signal directed to the ERD system 302, the transducer 352 generates an electrical signal that then lights the energizable material 324, propels the piston 322 and ruptures the pressure membrane 318 to establish fluid communication between the ERD reservoir 320 and the valve 304. As an example, referring to the system in FIG. 1, the ERD system 302 can be used to actuate the intermediate valve 132 that separates the two zones 106, 108.

Figure 11:
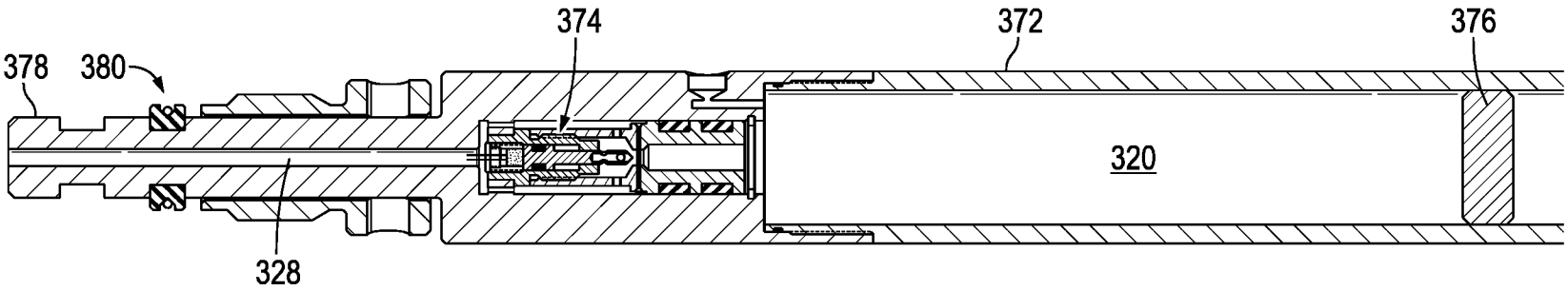
FIG. 11 illustrates features of an example ERD system that can be used with a pressure-powered tool, according to an embodiment.
Figure 12A:
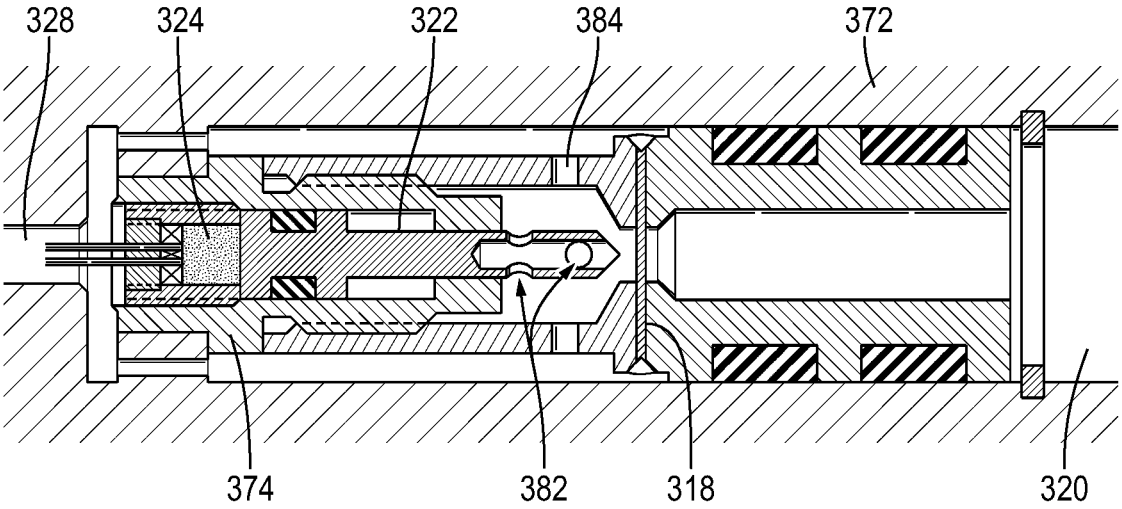
FIG. 12A provides a close-up view of features of the ERD system of FIG. 11 when the ERD system has not been activated.
Figure 12B:
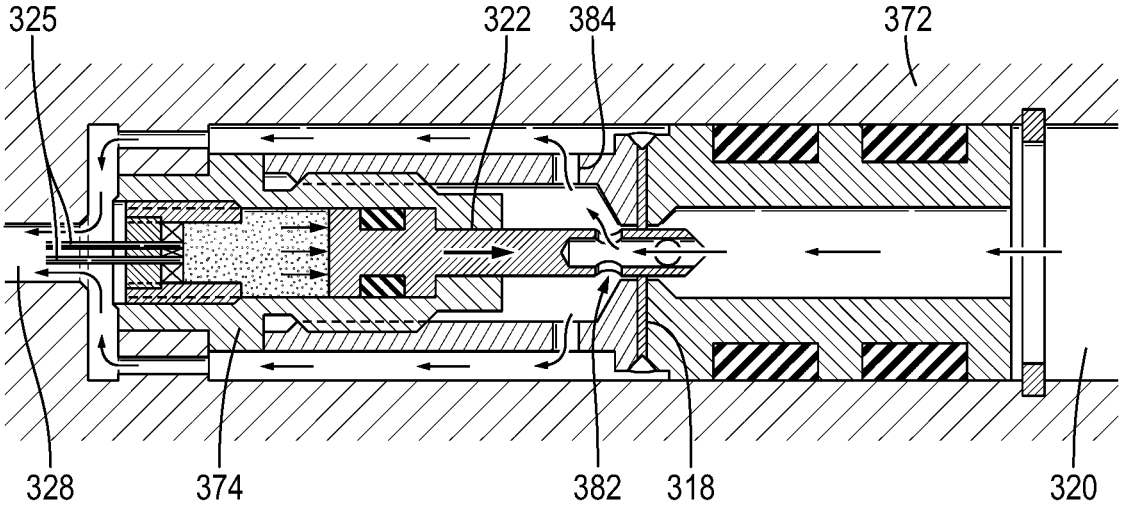
FIG. 12B provides a close-up view of features of the ERD system of FIG. 1 after the ERD system has been activated.

FIGS. 11, 12A and 12B illustrate features of an example ERD system 302 that can be used to activate a pressure-powered tool. The ERD system 302 includes a cylindrical housing 372 that contains a chamber 374 with the energizable material 324, the piston 322, the pressure membrane 318, and the ERD reservoir 320 containing fluid. The reservoir 320 is sealed by piston 376 that maintains the fluid in the reservoir 320 subject to the hydrostatic pressure of the well. An end 378 of the housing 372 can be coupled to the piston of a pressure-activated tool, such as the piston of valve 304 in FIGS. 9 and 10. The end 378 can include a seal 380 to ensure the integrity of the fluid coupling between the housing 372 and the valve 304. The housing 372 further includes the hydraulic control line or passageway 328 to establish a fluid communication path between the reservoir 320 and the valve 304.

With reference to FIG. 12B, in response to an activation command, the ERD system 302 generates a signal that energizes the energizable material 324 via lines 325, causing the piston 322 to move and rupture the breakable membrane 318. Rupture of the membrane 318 allows the pressurized fluid in reservoir 320 to flow through ports 382 in the piston 322, through ports 384, through the hydraulic line 328 and to the valve 304 where the fluid then energizes the piston of the valve 304 to shift the valve 304 to a desired state.

Although the preceding description has been described herein with reference to particular means, materials and embodiments, it is not intended to be limited to the particulars disclosed here; rather, it extends to all functionally equivalent structures, methods and uses, such as are within the scope of the appended claims.

What is claimed is:

1. A method of testing a subterranean formation intersected by a well, comprising:

running a test string into a well, the string including an apparatus positioned in the well to test the subterranean formation and including at least one pressure-powered tool that can be shifted between a plurality of states, the pressure-powered tool comprising:

a fluid chamber containing a reservoir of a pressurized fluid;

a piston in a piston chamber energizable by the pressurized fluid to shift the tool between states; and a hydraulic control system to establish a fluid communication path between the piston and the fluid chamber in response to a command to energize the tool to perform a downhole operation;

providing an indication of pressure in a region associated with the piston;

determining, based on the indication of pressure, which of the plurality of states the pressure-powered tool is in;

performing a corrective action based on the determination by activating an electric rupture disc (ERD) system, the ERD system comprising an ERD fluid reservoir and a breakable membrane, wherein, upon activation, the breakable membrane is ruptured to establish a fluid communication path between the ERD fluid reservoir and the tool to energize the piston.

2. The method as recited in claim 1, wherein the region associated with the piston is the piston chamber of the piston.

3. The method as recited in claim 2, wherein the indication of pressure is indicative of pressure in the piston chamber during shifting of the tool between states.

4. The method as recited in claim 1, further comprising determining, based on the indication of pressure, presence of a fluid leak in the hydraulic control system.

5. The method as recited in claim 4, further comprising determining, based on the indication of pressure and the volume of the reservoir, a time remaining before the tool fails.

6. The method as recited in claim 1, wherein performing the corrective action comprises mechanically shifting the tool to a desired state, and then continuing performing the downhole operation with the tool in the desired state.

7. The method as recited in claim 1, wherein the tool comprises a valve having a flow mandrel coupled to the piston by a breakable fastener, and wherein mechanically shifting comprises running a shifting tool into the string, engaging, with the shifting tool, a shifting profile on a surface of the flow mandrel, and moving the shifting tool to break the breakable fastener and thereby move the flow mandrel separately from the piston.

8. The method as recited in claim 1, wherein activating the ERD system comprises acoustically activating the ERD system.

9. The method as recited in claim 1, wherein the ERD system further comprises a heartbeat monitor circuit to receive a heartbeat signal from the hydraulic control system, and wherein the ERD system is activated based on the heartbeat signal.

10. A system to perform a test in a hydrocarbon well, comprising:

a control station;

a pressure-powered tool in communication with the control station, the pressure-powered tool comprising:

a fluid chamber containing a reservoir of fluid that is subjected to a pressure when the tool is deployed in the hydrocarbon well;

a piston in a piston chamber energizable by the pressurized fluid to shift the tool between operating states;

a hydraulic control system to control the operating state of the piston in response to a command from the control station, the hydraulic control system controlling the operating state by controlling a fluid communication path between the piston and the fluid chamber;

a pressure sensor to provide indications of pressure in a region within the tool, wherein the control station receives the indications of pressure and determines an operating condition of the pressure-powered tool based on the received indications; and wherein the pressure-powered tool further comprises an electric rupture disc (ERD) system in fluid communication with the piston, the ERD system comprising an ERD fluid reservoir containing a fluid and a breakable membrane, wherein, the control system activates the ERD system to rupture the breakable membrane and establish a fluid communication path between the ERD fluid reservoir and the piston to shift the tool to a desired operating state.

11. The system as recited in claim 10, wherein the tool includes a valve and the operating condition is a position of a valve.

12. The system as recited in claim 11, wherein, if the operating condition is indicative of a fluid leak, the control station further identifies a time remaining before the pressure-powered tool fails.

13. The system as recited in claim 10, wherein the pressure-powered tool comprises a valve having a flow port for a fluid flow produced by the hydrocarbon well.

14. The system as recited in claim 10, wherein the ERD system further comprises a heartbeat monitor circuit to receive a heartbeat signal from the hydraulic control system, wherein the heartbeat monitor circuit generates a signal to activate the ERD system to rupture the breakable membrane and establish the fluid communication path between the ERD fluid reservoir and the piston based on the heartbeat signal.

15. The method as recited in claim 10, wherein the control system further comprises an acoustic modem for acoustically activating the ERD system.

16. A method of determining an operating condition of a pressure-powered tool that can be shifted between operating states, comprising:

observing pressure in a region within the tool during shifting of the tool between operating states;

providing an indication of the observed pressure;

comparing the indication of the observed pressure with an expected pressure indication;

determining the operating condition of the tool based on the comparison;

if in an undesired operating condition, taking a corrective action; and wherein taking a corrective action comprises activating an ERD system to energize a piston of the tool, the ERD system comprising a rupture disc and a reservoir of a fluid, and activating the ERD system comprises generating a signal to rupture the rupture disc to establish a fluid communication path between the reservoir of the fluid and the piston of the tool.

17. The method as recited in claim 16, wherein if the undesired operating condition includes a fluid leak in the pressure-powered tool, then the method further comprises determining a time remaining before the tool fails.

18. The method as recited in claim 16, wherein taking a corrective action comprises mechanically shifting the tool to a desired operating condition.

19. The method as recited in claim 16, wherein activating the ERD system comprises acoustically activating the ERD system.

20. The method as recited in claim 16, wherein the ERD system further comprises a heartbeat monitor circuit to receive a heartbeat signal from a hydraulic control system, and wherein the ERD system is activated based on the heartbeat signal.

* * * * *